US012435608B2

(12) United States Patent
Banjar et al.

(10) Patent No.: US 12,435,608 B2
(45) Date of Patent: Oct. 7, 2025

(54) SYSTEM AND METHOD TO PREVENT SOLIDS FALLBACK IN ESP-LIFTED WELLS USING GEL

(71) Applicant: SAUDI ARABIAN OIL COMPANY, Dhahran (SA)

(72) Inventors: Hattan M. Banjar, Dammam (SA); Qasim Sahu, Thuwal (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/602,956

(22) Filed: Mar. 12, 2024

(65) Prior Publication Data

US 2025/0290392 A1 Sep. 18, 2025

(51) Int. Cl.

| | |
|---|---|
| ***E21B 43/12*** | (2006.01) |
| ***E21B 41/00*** | (2006.01) |
| ***E21B 43/34*** | (2006.01) |
| ***E21B 47/06*** | (2012.01) |

(52) U.S. Cl.

CPC ..... *E21B 43/128* (2013.01); *E21B 41/0021* (2013.01); *E21B 43/35* (2020.05); *E21B 47/06* (2013.01)

(58) Field of Classification Search

CPC ..... E21B 43/128; E21B 43/35; E21B 43/126; E21B 41/0021; E21B 47/06; E21B 43/129

See application file for complete search history.

(56) References Cited

U.S. PATENT DOCUMENTS

| | | | | |
|---|---|---|---|---|
| 7,806,186 | B2 | 10/2010 | Brown et al. | |
| 9,103,199 | B2 | 8/2015 | Lannom et al. | |
| 11,708,838 | B2 | 7/2023 | Beck et al. | |
| 2003/0145989 | A1 | 8/2003 | Shaw et al. | |
| 2010/0206567 | A1 | 8/2010 | Robinson et al. | |
| 2011/0155390 | A1* | 6/2011 | Lannom ..... | E21B 43/121 166/107 |

(Continued)

OTHER PUBLICATIONS

Zhao, Weishu et al., "Development of low density rigid gels/composites for ESP packer penetrator protection"; Proceedings of the SPE Kingdom of Saudi Arabia Annual Technical Symposium and Exhibition; Paper No. SPE-192260-MS; pp. 1-10; Apr. 23, 2018 (10 pages).

(Continued)

*Primary Examiner* — Caroline N Butcher

(74) *Attorney, Agent, or Firm* — Osha Bergman Watanabe & Burton LLP

(57) ABSTRACT

A method includes providing an electrical submersible pump assembly (ESP) with a pump, an intake, a gel canister, a protector, and a motor disposed in a casing. The method includes providing fluid communication between a production tubing and the ESP, the production tubing delivering well fluid containing solid particles and liquids from the ESP into a wellhead assembly through an inner bore of the production tubing. The method includes locating a pressure release conduit configured in a closed state, between a canister exterior in a hydraulic communication with a canister inner chamber of the gel canister and the inner bore. The closed state prevents the hydraulic communication between the canister inner chamber and the inner bore. The method includes delivering a canister contents to the well fluid.

21 Claims, 7 Drawing Sheets

(56) References Cited

U.S. PATENT DOCUMENTS

| | | | | |
|---|---|---|---|---|
| 2016/0298631 | A1* | 10/2016 | Reid | F04D 13/10 |
| 2018/0346793 | A1 | 12/2018 | Al-Zoraia et al. | |
| 2023/0174846 | A1 | 6/2023 | Alissa et al. | |
| 2023/0358116 | A1 | 11/2023 | Alsunnary et al. | |

OTHER PUBLICATIONS

Zhao, Weishu et al., "Chemical Solution to ESP Packer Penetrator Corrosion Problem"; Proceedings of the International Petroleum Technology Conference; Paper No. IPTC-19633-ABSTRACT; pp. 1-7; Jan. 13, 2020 (7 pages).

International Search Report issued in corresponding International Application No. PCT/US2025/019338; mailed Jul. 11, 2025 (5 pages).

Written Opinion of the International Searching Authority issued in corresponding International Application No. PCT/US2025/019338; dated Jul. 11, 2025 (6 pages).

* cited by examiner

600

| Gel Layer Thickness (mm) | Gel Weighted Ratio | Gel Density (g/cc) | | | | | | |
|---|---|---|---|---|---|---|---|---|
| | | 0.40 | 0.45 | 0.50 | 0.55 | 0.60 | 0.65 | 0.70 |
| 0.2 | 42.13% | 1.7021 | 1.7231 | 1.7442 | 1.7653 | 1.7863 | 1.8074 | 1.8285 |
| 0.4 | 63.56% | 1.2200 | 1.2517 | 1.2835 | 1.3153 | 1.3471 | 1.3789 | 1.4106 |
| 0.6 | 75.59% | 0.9493 | 0.9871 | 1.0249 | 1.0627 | 1.1005 | 1.1383 | 1.1761 |
| 0.8 | 82.85% | 0.7858 | 0.8272 | 0.8687 | 0.9101 | 0.9515 | 0.9929 | 1.0344 |
| 1.0 | 87.50% | 0.6813 | 0.7250 | 0.7688 | 0.8125 | 0.8563 | 0.900 | 0.9438 |
| 1.2 | 90.61% | 0.6113 | 0.6566 | 0.7019 | 0.7472 | 0.7925 | 0.8378 | 0.8831 |
| 1.4 | 92.77% | 0.5628 | 0.6091 | 0.6555 | 0.7019 | 0.7483 | 0.7947 | 0.8411 |
| 1.4 | 94.31% | 0.5280 | 0.5752 | 0.6223 | 0.6695 | 0.7166 | 0.7638 | 0.8109 |
| 1.8 | 95.44% | 0.5025 | 0.5502 | 0.5979 | 0.6457 | 0.6934 | 0.7411 | 0.7888 |
| 2.0 | 96.30% | 0.4833 | 0.5315 | 0.5796 | 0.6278 | 0.6759 | 0.7241 | 0.7722 |

610

*FIG. 6*

SYSTEM AND METHOD TO PREVENT SOLIDS FALLBACK IN ESP-LIFTED WELLS USING GEL

BACKGROUND

The disclosure relates generally to production of fluid from subterranean reservoirs. More particularly, the disclosure relates to a system and method to prevent solids fallback in wells that use electrical submersible pumps.

Fluids are typically produced from a reservoir in a subterranean formation by drilling a wellbore into the subterranean formation, establishing a flow path between the reservoir and the wellbore, and conveying the fluids from the reservoir through the wellbore to a destination such as to the surface of the earth, to a bed of a body of water such as a lakebed or a seabed, or to a surface of a body of water such as a swamp, a lake, or an ocean (hereafter "surface.") Fluids produced from a hydrocarbon reservoir may include natural gas, oil, and water. Typically, a production tubing is disposed in the wellbore to carry the fluids to the surface. In some formations, pressure within the rock formation causes the resources to flow naturally from the formation to the surface. One common challenge in producing fluids from a hydrocarbon reservoir through a wellbore is that, in some formations, the pressure in the formation is not adequate to cause the flow against gravity out of the formation to the surface or is not adequate to cause the flow to meet flowrate goals. In such instances, artificial lift technology can be used to add energy to fluid to bring the resources to the surface.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, a method that includes providing an electrical submersible pump assembly (ESP) with a pump, an intake, a gel canister, a protector, and a motor disposed in a casing. The method includes providing fluid communication between a production tubing and the ESP, the production tubing delivering well fluid containing solid particles and liquids from the ESP into a wellhead assembly through an inner bore of the production tubing. The method includes locating a pressure release conduit configured in a closed state, between a canister exterior in a hydraulic communication with a canister inner chamber of the gel canister and the inner bore. The closed state prevents the hydraulic communication between the canister inner chamber and the inner bore. The method includes delivering a canister contents to the well fluid.

This disclosure presents, in accordance with one or more embodiments, a system that includes an electrical submersible pump assembly (ESP) with a pump, an intake, a gel canister, a protector, and a motor disposed in a casing. The system includes a production tubing in fluid communication with the ESP and including an inner bore sized to deliver well fluid containing solid particles and liquids from the ESP into a wellhead assembly. The system includes a pressure release conduit configured in a closed state disposed between a canister exterior in a hydraulic communication with a canister inner chamber of the gel canister and the inner bore. The closed state prevents the hydraulic communication between the canister inner chamber and the inner bore. The system includes a canister contents disposed in the canister inner chamber of the gel canister configured to be delivered to the well fluid.

Other aspects and advantages of the claimed subject matter will be apparent from the following description and the appended claims.

BRIEF DESCRIPTION OF DRAWINGS

FIG. 6 shows an example data table, in accordance with one or more embodiments.

DETAILED DESCRIPTION

Figure 1:
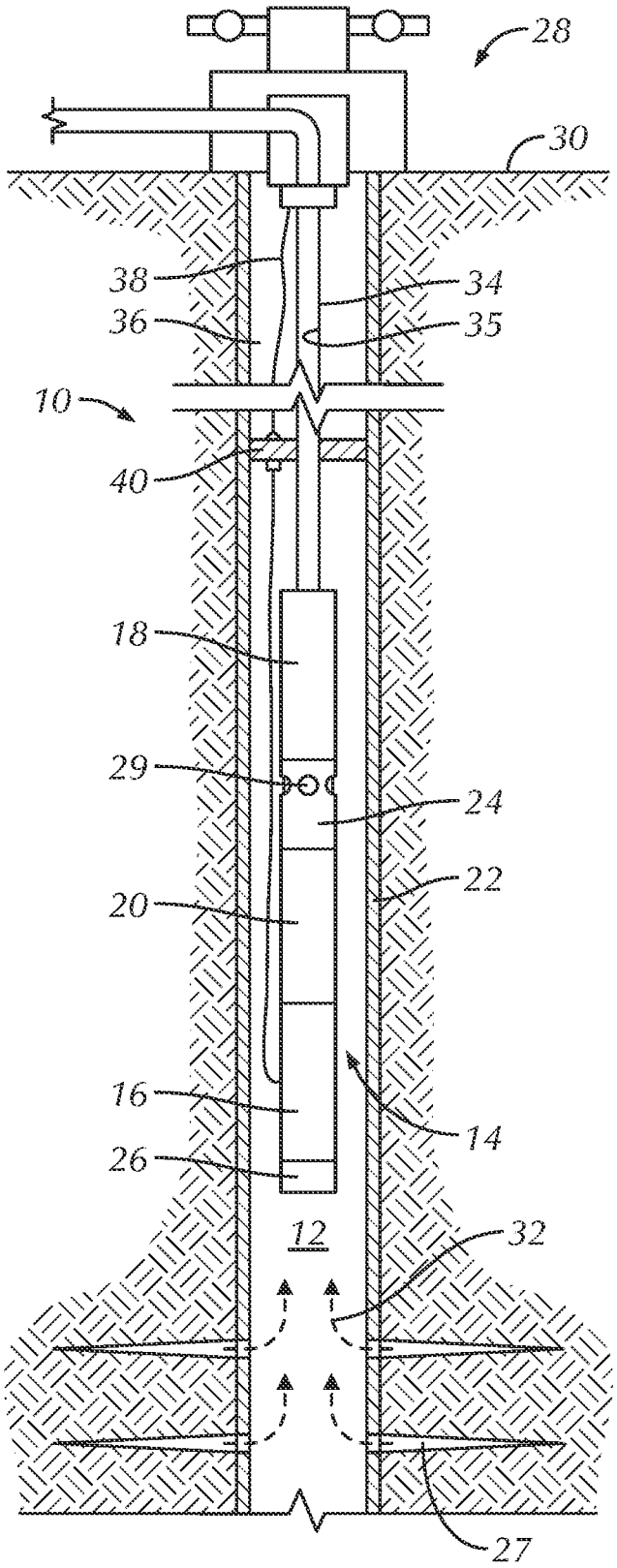
FIG. 1 shows a section view of a subterranean well having an electrical submersible pump assembly, in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Regarding the figures described herein, when using the term "down" the direction is toward or at the bottom of a respective figure and "up" is toward or at the top of the respective figure. "Up" and "down" are oriented relative to a local vertical direction. However, in the oil and gas industry, one or more activities take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. True vertical depth is the vertical distance from a point in the well at a location of interest to a reference point on the surface.

For bringing liquids and/or fluids out of a subterranean wellbore to the surface of the Earth, various techniques such as artificial lift technology may be used. The components of formation fluids, well fluids, etc. may include liquids and/or gases as well as solids such as sand and sediment. The solids may be suspended in the liquids and/or gases. Artificial lift technology may include, for example, a pump and associated components to assist in lifting the fluids up the wellbore. As an example, production tubing associated with the wellbore may include one or more pumps to assist in lifting the fluids up the wellbore. The pump may be electrically operated and located submerged in the fluid at or near the bottom of the well. The pump system may use a surface or seabed power source to drive the submerged pump assembly. Alternatively, power for the pump may be provided at another location downhole in the well, such as a downhole fuel cell. These pump systems so configured are termed electric submersible pump (ESP) systems.

Notably, ESP performance may be impacted by various reservoir characteristics such as, for example, gas-oil ratio, water cut, suspended solids, flowing wellhead pressure (FWHP), well test liquid rate, and pump operating frequency. It is beneficial to be able to adjust parameters to optimize ESP performance. The performance of ESPs may be optimized by adjusting the pump control settings to maximize pump operating efficiency and minimize overall power consumption for a determined target well rate.

Electric Submersible Pumps (ESPs) have been considered the least preferred artificial lift option in oil or water wells that have high sand or solids content. However, due to their capabilities of handling high flowrates and the increase of their reliability, ESPs have been used to produce formation fluids in wells with high solid ratios.

Solids (including sand) are harmful byproducts which cannot be avoided most of the time when producing formation fluids. One major solids issue in ESPs is the blockage on flow channels in ESP stages, especially when the flow is stopped and solids in the production tubing fall back to the ESP top stages.

In ESP equipped wells where a Y-Tool may be installed, solids fall back to the bypass section and the solids accumulates on top of the blanking plug. Accumulation of solids on top of the blanking plug may block the fish neck profile, and hence, the fishing tool may not be able to fish the blanking plug whenever retrieving the blanking plug is needed. Accessibility to the well below the ESP will be impossible since the blanking plug becomes unretrievable unless the whole completion is retrieved by a rig.

Current available solutions are based on mechanical means such that the flow path above the ESP stages is diverted to the ESP-casing annulus as soon as the ESP is stopped or de-energized, using an auto flow valve. Another available solution is to use a filter to capture the falling solids. This filter approach can create an unnecessary pressure drop while the well is flowing, and the filter may need periodic maintenance. In general, the accumulated solids above the ESP can be of relatively high volume, thus there is always a risk of solids falling back to the top ESP stages as soon as the ESP is restarted.

As such, embodiments disclosed herein present systems and methods that may enable producing a well, reduce the solids fallback of solids suspended in the produced well fluids (e.g., produced formation fluids), and improve well production.

FIG. 1 shows a system for producing hydrocarbons from subterranean well 10. Subterranean well 10 includes wellbore 12. Electrical submersible pump assembly (e.g., an ESP 14) is located within wellbore 12. Wellbore 12 can include outer tubular member 22, which can be, for example, a well casing or other large diameter well tubing. ESP 14 includes a motor 16 at or near the lowermost end of ESP 14. Motor 16 is used to drive a pump 18 at an upper portion of ESP 14. Between motor 16 and pump 18 is protector 20 and intake 24. Protector 20 can be used for equalizing pressure within ESP 14 with that of wellbore 12, for providing a seal between intake 24 and motor 16, for containing an oil reservoir for motor 16, and for helping to convey the thrust load of the pump 18.

A monitoring sub such as sensor 26 may be included in ESP 14 as an optional element. In the example embodiment of FIG. 1, sensor 26 is located at a lower end of motor 16. Sensor 26 can gather and provide data relating to operations of ESP 14 and conditions within wellbore 12. As an example, sensor 26 can monitor and report the intake pressure and temperature and the discharge pressure and temperature of the pump 18. The sensor may monitor and report the lubricating oil and winding temperatures of the motor 16, the assembly vibration of ESP 14 in multiple axes, and any leakage current of motor 16 of ESP 14.

In accordance with one or more embodiments, pump 18 is adjacent to intake 24, intake 24 is located between pump 18 and protector 20, protector 20 is located between intake 24 and motor 16, and motor 16 is located further within subterranean well 10 than pump 18. Therefore, from top to bottom the elements are ordered: pump 18, intake 24, protector 20, and motor 16.

Well fluid such as well fluid F (e.g., a well fluid 32) is shown entering wellbore 12 from a formation adjacent to the wellbore 12 through perforations 27. Well fluid F for production, flows to opening 29 of intake 24.

Well fluid F is pressurized by pump 18 and travels up to wellhead assembly 28 at surface 30 through an elongated tubular member (e.g., a production tubing 34). Production tubing 34 is in fluid communication with ESP 14. The production tubing has an inner bore (e.g., an inner bore 35) sized to deliver well fluid F from ESP 14 to wellhead assembly 28. ESP 14 is positioned within wellbore 12 so that motor 16 is located downstream, or uphole, of perforations 27 through the outer tubular member 22 so that well fluid F flowing through perforations 27 pass the motor 16 before entering intake 24. This helps to cool motor 16 with well fluid F.

ESP 14 is suspended from, and supported by, the elongated tubular member (e.g., the production tubing 34). The elongated tubular member (production tubing 34) extends within subterranean well 10. Production tubing 34 can be formed of carbon steel material, carbon fiber tube, or other types of corrosion-resistant alloys or coatings.

Well fluid F may contain both gases and liquids as well as suspended solids as the well fluid enters the intake 24. Both the gases and liquids together with suspended solids can be produced to wellhead assembly 28 through production tubing 34 as a combined production fluid. Pump 18 is operable to provide artificial lift to well fluid F that contain a combined gas and liquid mixture and production tubing 34 has an inner bore sized to deliver the combined gas and liquid mixture to wellhead assembly 28.

Well fluid F is produced through production tubing 34. There is no outlet for well fluid within ESP 14 to travel back into wellbore 12, i.e., well fluids F are not produced through the tubing-casing annulus 36. Tubing-casing annulus 36 is an annular space located between an outer diameter of production tubing 34 and an inner diameter of outer tubular member 22.

Power cable 38 extends through wellbore 12 alongside production tubing 34. Power cable 38 can provide the power required to operate motor 16 of ESP 14. Power cable 38 extends to a packer assembly (e.g., a packer 40) and can be connected to packer with a packer penetrator at the top side of packer. Power cable 38 can then extend between packer and motor 16 with a motor lead extension. The motor lead extension can be connected to a packer penetrator at the bottom side of packer. Power cable 38 can be a suitable power cable for powering an ESP 14, known to those with skill in the art.

Figure 2:
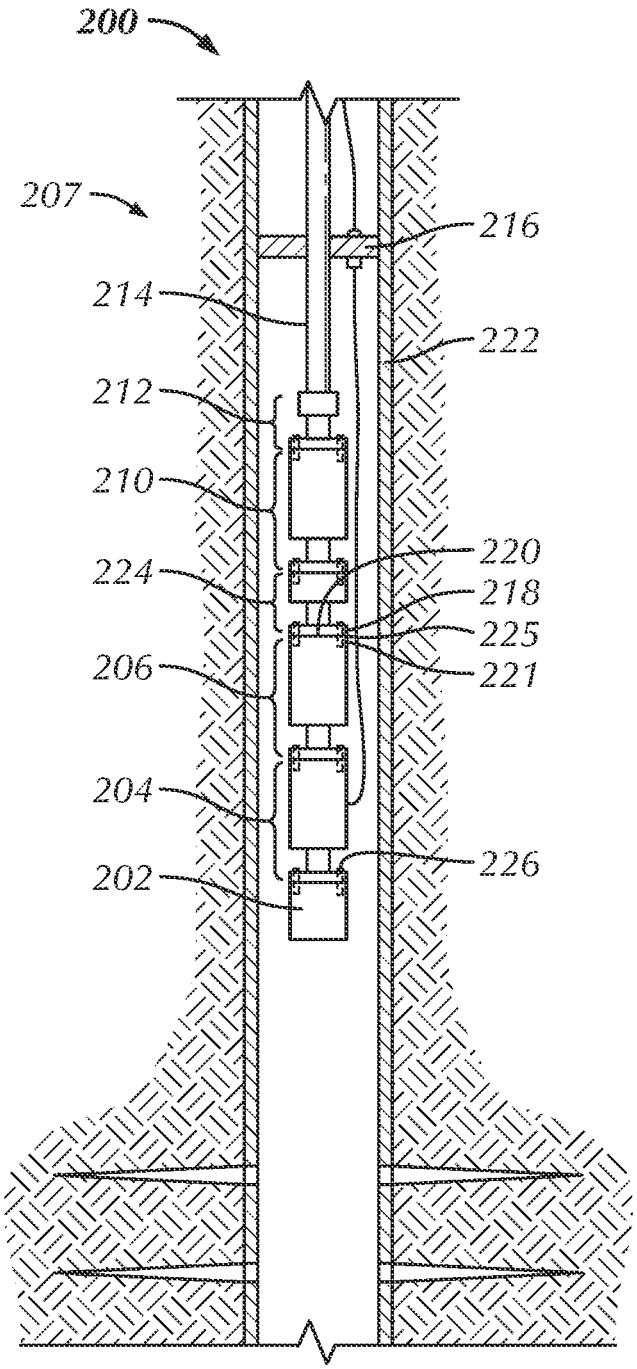
FIG. 2 shows a section view of an electrical submersible pump assembly, in accordance with one or more embodiments.

FIG. 2 shows the conventional configuration of a tubing-deployed ESP (e.g., tubing-deployed ESP 200). In typical field installations, the monitoring sub or downhole gauge, e.g., a sub 202) is coupled to a motor (e.g., motor 204) via a flanged connection. This combined sub-assembly (e.g., the sub and the motor) is first lowered in a well (e.g., well 10, FIG. 1) before the bottom portion of a protector (e.g., protector 206) is coupled to the top part (uphole end) of the motor via another flanged connection. The three connected components (e.g., the sub, the motor, and the protector) are lowered in the well. A downhole end (e.g., an intake downhole end 207) of a pump intake 224 has an intake base flange (e.g., an intake base flange 218). The intake base flange is connected to an uphole end of the protector (e.g., a protector top surface 220) at a protector top flange (e.g., a protector top flange 221). The coupling of the protector top flange to the intake base flange forms an intake-protector interface (e.g., an intake-protector interface 225). Coupling the flanges may use fasteners (e.g., fasteners 226) as known in the art.

The coupling method is repeated for the installation of a pump (e.g., a pump 210) and a discharge head 212. The production tubing (e.g., pipe element 214) is typically threaded into the discharge head and entire downhole assembly is lowered into the well in stepwise manner as additional production tubing is connected by field personnel on the rig floor. Once the entire downhole assembly reaches the desired setting depth, a packer assembly (e.g., a packer 216) is set to contact the inner walls of the casing (e.g., outer tubular member 222), thereby providing the required isolation in the well prior to commencing production.

Figure 3:
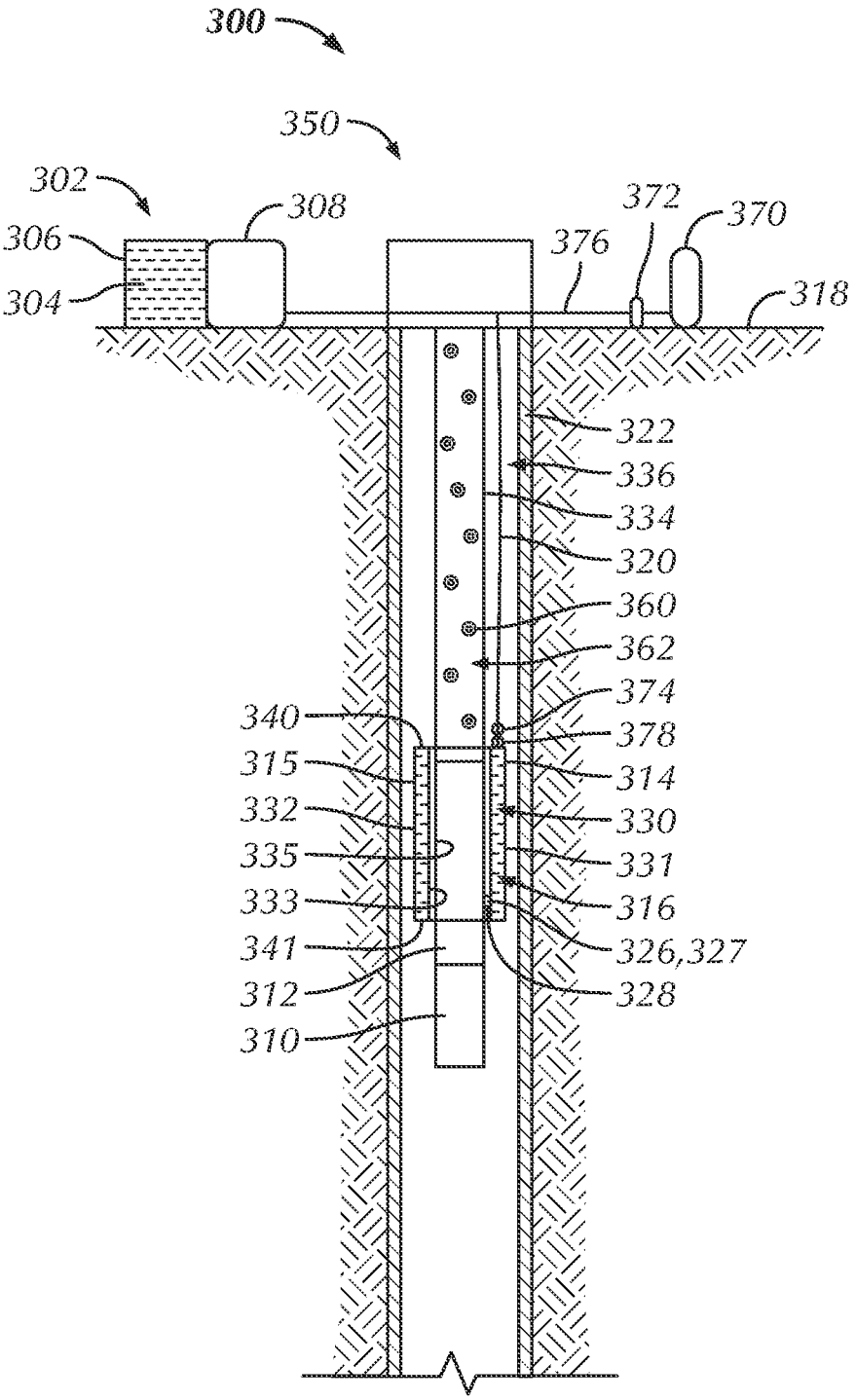
FIG. 3 shows a system, in accordance with one or more embodiments.

FIG. 3 shows a system in accordance with one or more embodiments. The system (e.g., gel system 300) includes a gel source (e.g., a gel source 302) that includes a gel (e.g., a gel 304) in a gel supply tank (e.g., a tank 306). The tank at surface stores the gel. The gel system also includes a gel pump (e.g., a pump 308), an electrical submersible pump (ESP) (e.g., an ESP 310) equipped with an ESP discharge head (e.g., discharge head 312) and a gel canister (e.g., a canister 314). The pump at surface is used to inject the gel into the downhole canister through a capillary line. The canister may be pressurized thereby forming a pressurized gel canister. The canister is located downhole from the surface at a position, for example, downstream of or uphole from, the ESP discharge head. The canister is configured to store a canister contents such as a low-density gel (e.g., a stored gel 316).

The canister is automatically filled, refilled, and/or replenished with the gel from the surface (e.g., a surface 318) such as a wellsite (e.g., a wellsite 350). The canister is pressurized from the surface through the capillary line such as a stainless-steel instrument tube (e.g., a tube 320) using the gel from gel source, the gel supply tank, and the gel pump. The capillary line is thereby used to transfer the pumped gel from the tank to the canister downhole.

In the practice of oil production from a reservoir up to the surface, if the oil flow stops, then solids suspended in the oil production stream may settle out of the production stream and fall downhole due to gravity if the solids have a higher density than the production stream fluid densities (e.g., the formation fluid density). This behavior may be termed solids fallback. Likewise, oil production using the ESP may experience solids fallback. For example, on an occasion when an ESP stops or is stopped, solids may fall back down through the fluid column to the top of the ESP.

FIG. 3 shows that the ESP downhole components include the canister and the ESP coupled to a pipe element such as a production tubing (e.g., a tubing 334) and are disposed in another pipe element, i.e., an outer tubular member (e.g., a casing 322). When the ESP stops, a tubing pressure above (i.e., downstream of or uphole from) the ESP may drop, thereby forming a pressure differential between the tubing pressure within the tubing and the formation pressure in the annular space (e.g., a tubing-casing annulus 336) defined by the exterior of the tubing (e.g., an outer diameter of the tubing 334) and the interior of the casing (e.g., an inner diameter of the outer tubular member, i.e., the casing 322).

In accordance with one or more embodiments, the gel system may be activated due to the change in the pressure differential. In this manner the gel system may be activated by a signal, the signal being a pressure drop creating a pressure differential below a predetermined pressure setpoint. Delivering the canister contents may include detecting a signal which makes a pressure release conduit be in the open state upon detecting the signal. The signal may be from a mechanical device, such as a spring-loaded check valve, i.e., a pressure relief valve, which is set to trigger at a predetermined pressure. Therefore, delivering the canister contents may include detecting a pressure and opening the pressure release conduit upon detecting a detected pressure.

The signal may be from an electronic device, such as a pressure sensor, that sends the signal to a control system, to a computer system (e.g., a computer system 370), and/or to a computer processor. In some embodiments, the gel system may include a computer system that is similar to the computer system (e.g., a computer 802) described below with regard to FIG. 8 and the accompanying description. The computer system may include a surface communication interface (e.g., a surface interface 372). The electronic device may have a downhole communication interface (e.g., a downhole interface 374) for transmitting and receiving signals.

The computer system may include an instrument cable or a communication cable (e.g., an instrument cable 376) for transmitting and/or receiving data, signals, and commands to various instruments. In accordance with one or more embodiments the instrument cable 376 may comprise a fiber optic cable. Instrument examples include a pressure transducer (e.g., a transducer 378) and/or an electronically-operated valve (e.g., an instrument valve 327). The instrument cable may be coupled to the computer system, to the surface interface 372 and to the transducer 378. The instrument cable may be coupled to the power cable (e.g., power cable 38, FIG. 1) and the signals may be sent over the power cable, i.e., piggybacked and/or multiplexed. The downhole interface and/or the transducer may comprise a computer processor for encoding and decoding data, signals, and commands. For example, the downhole interface may use a computer processor to encode and/or decode light signals transmitted over fiber optic cable.

The method may include delivering the canister contents and may further include detecting a pressure at a pressure detector and opening the pressure release conduit upon detecting a predetermined pressure. In the case of a detecting a predetermined pressure, the pressure detector may send a signal to the control system where the signal is compared with a predetermined criteria such as a target pressure. The control system may actuate the valve to change the valve state from closed state to open state, or vice versa, when the comparison results in the predetermined criteria being met.

The gel system may include a means for controlling the flow of the gel such as a check valve (e.g., check valve 326) in hydraulic communication with the canister. The check valve may be located, for example, on the inner side of the canister between the canister contents and the elongated tubular member bore (e.g., the production tubing bore). The check valve may comprise, for example, two operational states including an open state and a closed state. The check valve may be in hydraulic communication with a pressure release conduit (e.g., conduit 328). The check valve may be configured to provide the pressure release conduit with an open state and a closed state corresponding to the check valve open state and the check valve closed state, respectively. The check valve may open when the ESP stops, or the pressure drops. The open check valve allows injecting the gel through the pressure release conduit at a location, for example, just above the ESP until all gel in the canister, i.e., in a canister inner chamber (e.g., a chamber 330) is dispensed or until the pressure in the canister equalizes with the pressure above the ESP, thereby closing the check valve.

Although embodiments disclosed here describe use of a check valve, this is not intended to be limiting. One of ordinary skill in the art will appreciate that the check valve may be of any suitable valve without departing from the scope of embodiments disclosed herein. Any suitable valve providing similar functionality to that described may also be implemented without departing from the scope of the present disclosure. For example, the gel system may include a pressure relief valve or safety valve in hydraulic communication with the conduit that dispenses the gel at a predetermined pressure differential between the pressure in the gel canister and the pressure in the tubing. Other examples of means of controlling the flow of the gel may include valves such as instrument valves (e.g., the instrument valve 327), pressure regulator valves, pilot-operated check valves, directional valves, sliding sleeves, globe valves, butterfly valves, diaphragm valves, gate valves, ball valves, and plug valves.

In accordance with one or more embodiments, the canister 314 may be annular-shaped. The canister annular shape may be configured to circumscribe the production tubing (e.g., the tubing 334), for example. The canister annular shape includes the canister inner chamber (e.g., the chamber 330) and a canister wall (e.g., a canister wall 331) between the canister inner chamber and a canister exterior 315 (e.g., a canister exterior 315). In this manner the canister exterior 315 includes a canister outer wall (e.g., a canister outer wall 332), a canister inner wall (e.g., a canister inner wall 333), a canister uphole wall (e.g., a canister uphole wall 340) and a canister downhole wall (e.g., a canister downhole wall 341). The pressure release conduit (e.g., the conduit 328) may therefore provide hydraulic communication between the chamber and tubing inner bore (e.g., a tubing bore 335) from any location of the canister exterior 315, including the canister outer wall 332, the canister inner wall 333, the canister uphole wall 340, and/or the canister downhole wall 341.

The gel is viscous enough to carry the falling solids while the gel density is much lower than that of the formation fluid, which can be oil, water, or other substance in any combination. The gel couples to one or more solid particles (e.g., a particle 360) to form a gel-solids combination (e.g., a gel-solids particle) such as a slurry (e.g., a slurry 362). The gel now carrying solids (suspended gel with solid particles), i.e., the slurry, starts travelling upward due to gravity difference (buoyancy) until the gel-solids combination reaches an equilibrium point in terms of density at a certain depth from surface. Before, when, or soon after the ESP is energized, the downhole canister is refilled and re-pressurized, and the suspended gel with solid particles will flow to surface.

The gel is filled and stored in the canister above the ESP whenever the ESP is running. When the ESP stops or is stopped, formation fluid and solids in the tubing will fall back to the depth of the ESP and to below the ESP due to gravity if the solids are higher density than the formation fluid density. In accordance with one or more embodiments solids may be captured by injecting gel through the one-way check valve just above the ESP into the tubing where the gel combines with the formation fluid. In this manner the gel will suspend the solids that are falling back. The suspension is a result of a gravity difference (e.g., buoyancy) with the formation fluid.

An example gel has a viscosity higher than the formation fluid to couple to and carry solids. Furthermore, the gel has a density that is lower than the formation fluid density. The gel combined with a suspended particle may also have a combined density lower than the formation fluid density in order to make the gel and solid mixture travel uphole as a result of density difference. This method thereby mitigates the risk of solids falling back as soon as the ESP stops.

Whenever the gel is dispensed as a result of ESP stoppage, the canister is automatically refilled and repressurized from surface through the capillary line using the pump, by setting a target pressure value in the capillary line to overcome a predetermined check valve pressure setting. For example, if the tubing pressure is 5000 psi with the ESP running and the tubing pressure is 500 psi with the ESP turned off (i.e., the ESP stopped), then the gel will dispense with a check valve set at 750 psi, i.e., as the tubing inner bore pressure drops to 750 psi or below, then the check valve opens, and the gel is dispensed out of the canister.

Figure 4:
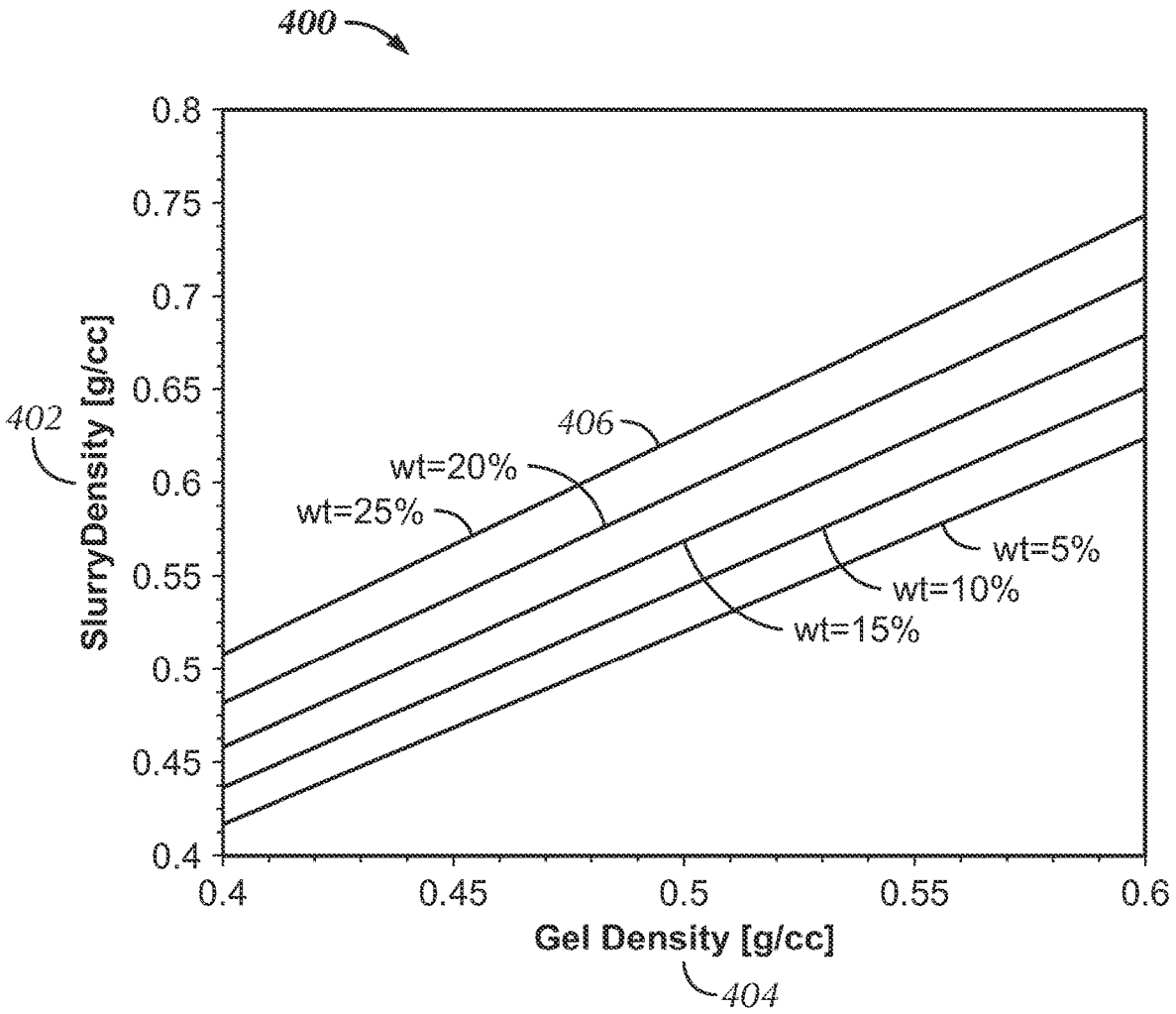
FIG. 4 shows an example graph, in accordance with one or more embodiments.

FIG. 4 shows an example plot (e.g., a plot 400) of total slurry density (e.g., a slurry density 402), a gel density (e.g., a gel density 404), and a weight percent (e.g., a weight percent 406) regarding a formation fluid density. Regarding gel composition and functionality, a mixture that contains low-density materials and composites may be used as a low-density gel to prevent solids fallbacks. The gel has a density lower than the oil density and/or the formation fluid density while having sufficient viscosity to suspend solids. An aqueous dispersion mixture of colloidal silica combined with a density reducing agent can be utilized to achieve this objective. A density range between 0.4 and 0.6 g/cc can be controlled depending on the application. In accordance with one or more embodiments, an example low-density gel comprises:

- Colloidal silica dispersion (20%-40% solid by weight);
- Hollow glass microsphere as density reducing agent;
- Thermoplastic microsphere as a low-density filler;
- Salt such as NaCl/KCL can be used to control the gelation (1%-5%);
- pH control agent to achieve the desired gelation (another alternative to trigger viscosity increase) the above recipe can be manipulated to achieve the required density depending on the density of the formation fluid being produced.

FIG. 4 shows an example plot derived from example calculations to estimate the gel density needed. The plot in FIG. 4 shows the slurry density calculation (gel+suspended solids), considering the density of the gel, the solid density, and the solids concentration in the slurry. The plot in FIG. 4 illustrates that using an example proposed formulated gel, the total slurry density is less than the formation fluid density. The plot illustrates the feasibility of preventing solids fallbacks and/or causing the slurry to stay above the formation fluid due to density differences.

Figure 5:
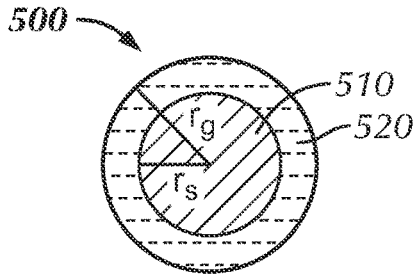
FIG. 5 shows an example gel and particle, in accordance with one or more embodiments.

FIG. 5 illustrates an example of a solid particle with a gel layer (e.g., a gel-solids particle 500). A spherical solid particle (e.g., a particle 510), is shown encapsulated by a spherical gel layer (e.g., a layer 520) surrounding the spherical solid particle.

FIG. 6 shows an example analysis (e.g., a table 600) for suspending and lifting a solid particle. The weighted density average of the mixture (solid particle and gel layer) is dependent on the thickness on the gel layer. Given the following example parameters, an analysis illustrates that disclosed embodiments may suspend and lift the solid particle:

Light formation fluid density (50 API)=0.78 g/cc.

Solid particle density (assuming sand)=1.6 g/cc

Max solid particle size diameter=2 mm $r_g$ is the gel radius, and $r_s$ is the solid radius.

$$\text{Mixture density} = \frac{\text{Mass}_{Total}}{\text{Volume}_{Total}} = \frac{\text{Mass}_{Solid} + \text{Mass}_{Gel}}{\text{Volume}_{Solid} + \text{Volume}_{Gel}} = \frac{\text{Density}_{Solid} \times \text{Volume}_{Solid} + \text{Density}_{Gel} \times \text{Volume}_{Gel}}{\text{Volume}_{Solid} + \text{Volume}_{Gel}} = \frac{\rho_s \times \frac{4}{3}\pi r_s^3 + \rho_g \times \frac{4}{3}\pi(r_g^3 - r_s^3)}{\frac{4}{3}\pi r_s^3 + \frac{4}{3}\pi(r_g^3 - r_s^3)} = \frac{\rho_s \times r_s^3 + \rho_g \times (r_g^3 - r_s^3)}{r_s^3 + (r_g^3 - r_s^3)} = \frac{\rho_s r_s^3 + \rho_g r_g^3 - \rho_g r_s^3}{r_g^3}$$

Using the example parameters and targeting a mixture density to be lower than the lightest oil, calculations are shown in the table in FIG. 6. FIG. 6 illustrates that there is a wide range of possibilities between the gel density and the gel layer thickness as illustrated in the highlighted values (e.g., successful density layer values 610). The gel layer needs to be at least 1 mm thick with gel density of 0.4-0.7 g/cc, dependent on the gel ratio by volume. If the gel layer is 2.0 mm thick or higher, then the gel will be able to suspend and carry solid to surface independent on the gel density.

Figure 7:
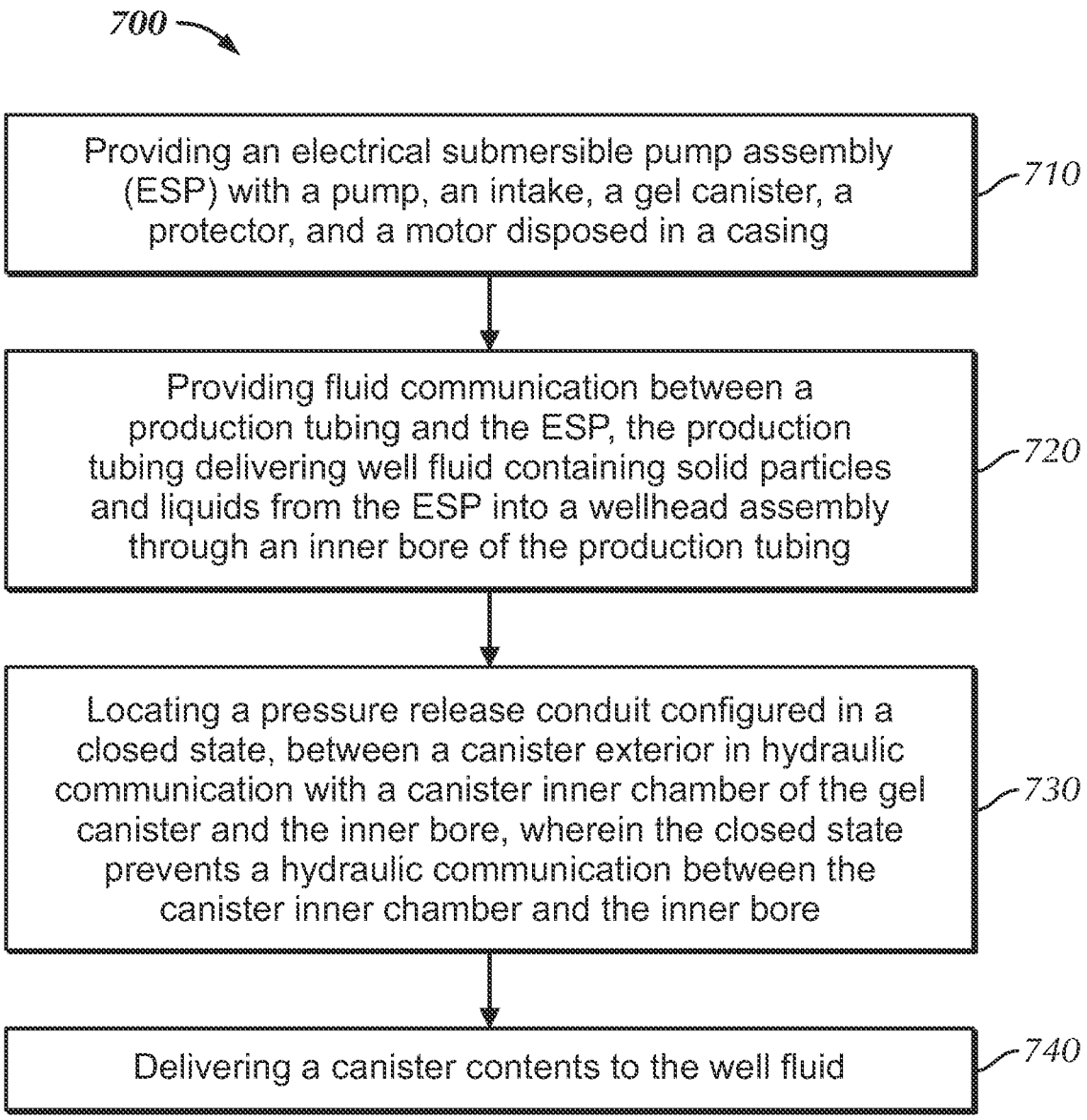
FIG. 7 shows a flowchart, in accordance with one or more embodiments.

Turning to FIG. 7, FIG. 7 shows a flowchart (e.g., a method 700) in accordance with one or more embodiments. Specifically, FIG. 7 describes a general method using a tubing-deployed ESP with a gel system to flow fluids in various pipe components in a wellbore. One or more blocks in FIG. 7 may be performed by one or more components, e.g., as described in FIGS. 1, 2, 3, 4, 5, 6, and 8. While various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

FIG. 7 shows a flowchart of an example method for producing a well.

At step 710, the method includes providing an electrical submersible pump assembly (ESP) with a pump, an intake, a gel canister, a protector, and a motor disposed in a casing.

At step 720, the method includes providing fluid communication between a production tubing and the ESP, the production tubing delivering well fluid containing solid particles and liquids from the ESP into a wellhead assembly through an inner bore of the production tubing.

At step 730, the method includes locating a pressure release conduit configured in a closed state, between a canister exterior in hydraulic communication with a canister inner chamber of the gel canister and the tubing inner bore, wherein the closed state prevents a hydraulic communication between the canister inner chamber and the inner bore. The pressure release conduit may be configured to deliver the canister contents to the inner bore.

The pressure release conduit may include a check valve configured to open the pressure release conduit to deliver the canister contents. For example, the check valve may open the conduit upon detecting that a predetermined criterion is met. The inner bore may have a bore pressure and the canister inner chamber may have a chamber pressure. The difference between the bore pressure and the chamber pressure may form a pressure differential. The predetermined criterion may be the pressure differential between the bore pressure and the chamber pressure.

At step 740, the method includes delivering a canister contents to the well fluid. For example, the pressure release conduit may include an open state allowing the hydraulic communication, using the canister exterior, between the canister inner chamber and the inner bore. Delivering the canister contents may include detecting a signal which makes the pressure release conduit be in the open state upon detecting the signal. The signal may be from a mechanical device, such as a spring-loaded check valve, i.e., a pressure relief valve, which is set to trigger at a predetermined pressure.

Figure 8:
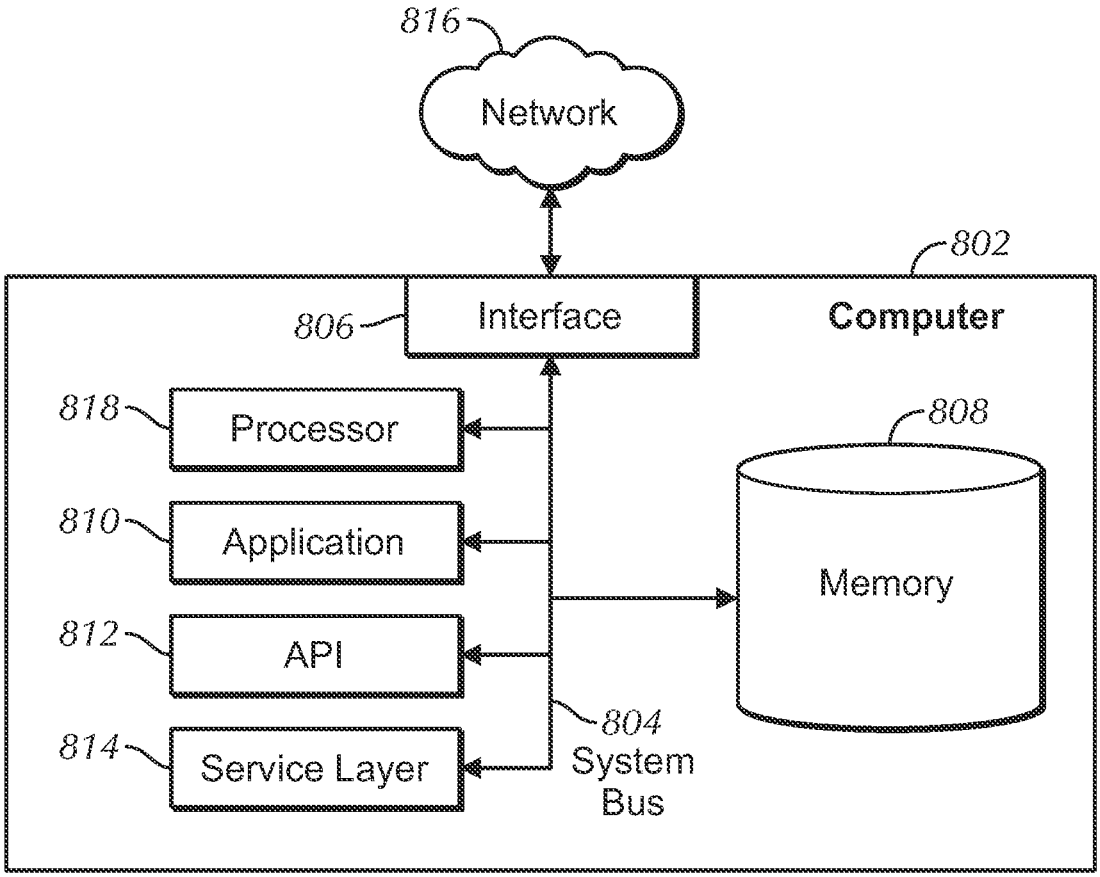
FIG. 8 shows a computer system in accordance with one or more embodiments.

In some embodiments, the gel system may include a computer system that is similar to the computer system (e.g., a computer 802) described below with regard to FIG. 8 and the accompanying description. The signal may be from an electronic device, such as a pressure sensor, which sends the signal to a control system, to a computer system, and/or to a computer processor. The electronic device may have a communication interface. Therefore, delivering the canister contents may include detecting a pressure and opening the pressure release conduit upon detecting a detected pressure. The method may include delivering the canister contents may include detecting a pressure at a pressure detector and opening the pressure release conduit upon detecting a predetermined pressure. In the case of detecting a predetermined pressure, the pressure detector may send a signal to the control system where the signal is compared with a predetermined criteria such as a target pressure. The control system may actuate the valve to change the valve state from closed state to open state, or vice versa, when the comparison results in the predetermined criteria being met.

The canister contents may comprise a density range of from about 0.4 g/cc (grams per cubic centimeter) to 0.6 g/cc. Furthermore, the canister contents may include an aqueous dispersion mixture, a density-reducing agent, a low-density filler, a gelation control agent; and a pH control agent. In accordance with one or more embodiments the aqueous dispersion mixture may comprise a colloidal silica dispersion in a range of from 20% to 40% solid by weight. The density-reducing agent may comprise a hollow glass microsphere (HGM). The low-density filler may comprise thermoplastic microspheres. The gelation control agent may comprise a salt in a gelation range of from 1% to 5%.

Embodiments may be implemented on a computer system. FIG. 8 is a block diagram of a computer system (e.g., the computer 802) used to provide computational functionalities associated with described algorithms, methods, functions, processes, flows, and procedures as described in the instant disclosure, according to an implementation. The illustrated computer (e.g., the computer 802) is intended to encompass any computing device such as a high-performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 802 may include a computer that includes an input device, such as a keypad, keyboard, touch screen, or other device that can accept user information, and an output device that conveys information associated with the operation of the computer 802, including digital data, visual, or audio information (or a combination of information), or a GUI.

The computer 802 can serve in a role as a client, network component, a server, a database or other persistency, or any other component (or a combination of roles) of a computer system for performing the subject matter described in the instant disclosure. The illustrated computer (e.g., the computer 802) is communicably coupled with a network 816. In some implementations, one or more components of the computer 802 may be configured to operate within environments, including cloud-computing-based, local, global, or other environment (or a combination of environments).

At a high level, the computer 802 is an electronic computing device operable to receive, transmit, process, store, or manage data and information associated with the described subject matter. According to some implementations, the computer 802 may also include or be communicably coupled with an application server, e-mail server, web server, caching server, streaming data server, business intelligence (BI) server, or other server (or a combination of servers).

The computer 802 can receive requests over network 816 from a client application (for example, executing on another computer 802) and responding to the received requests by processing the said requests in an appropriate software application. In addition, requests may also be sent to the computer 802 from internal users (for example, from a command console or by other appropriate access method), external or third-parties, other automated applications, as well as any other appropriate entities, individuals, systems, or computers.

Each of the components of the computer 802 can communicate using a system bus 804. In some implementations, any or all of the components of the computer 802, both hardware or software (or a combination of hardware and software), may interface with each other or with an interface 806 (or a combination of both) over the system bus 804 using an application programming interface (API) (e.g., an API 812) or a service layer 814 (or a combination of the API 812 and service layer 814. The API 812 may include specifications for routines, data structures, and object classes. The API 812 may be either computer-language independent or dependent and refer to a complete interface, a single function, or even a set of APIs.

The service layer 814 provides software services to the computer 802 or other components (whether or not illustrated) that are communicably coupled to the computer 802. The functionality of the computer 802 may be accessible for all service consumers using this service layer. Software services, such as those provided by the service layer 814, provide reusable, defined business functionalities through a defined interface. For example, the interface may be software written in JAVA, C++, or other suitable language providing data in extensible markup language (XML) format or other suitable format. While illustrated as an integrated component of the computer 802, alternative implementations may illustrate the API 812 or the service layer 814 as stand-alone components in relation to other components of the computer 802 or other components (whether or not illustrated) that are communicably coupled to the computer 802. Moreover, any or all parts of the API 812 or the service layer 814 may be implemented as child or sub-modules of another software module, enterprise application, or hardware module without departing from the scope of this disclosure.

The computer 802 includes the interface 806. Although illustrated as a single interface in FIG. 8, two or more of the interface 806 may be used according to particular needs, desires, or particular implementations of the computer. The interface 806 is used by the computer 802 for communicating with other systems in a distributed environment that are connected to the network 816. Generally, the interface (804 includes logic encoded in software or hardware (or a combination of software and hardware) and operable to communicate with the network 816. More specifically, the interface 806 may include software supporting one or more communication protocols associated with communications such that the network 816 or interface's hardware is operable to communicate physical signals within and outside of the illustrated computer (e.g., the computer 802).

The computer 802 includes at least one computer processor (a computer processor 818). Although illustrated as a single computer processor in FIG. 8, two or more processors may be used according to particular needs, desires, or particular implementations of the computer. Generally, the computer processor 818 executes instructions and manipulates data to perform the operations of the computer and any algorithms, methods, functions, processes, flows, and procedures as described in the instant disclosure.

The computer 802 also includes a memory 808 that holds data for the computer or other components (or a combination of both) that can be connected to the network 816. For example, memory 808 can be a database storing data consistent with this disclosure. Although illustrated as a single memory in FIG. 8, two or more memories may be used according to particular needs, desires, or particular implementations of the computer 802 and the described functionality. While memory 808 is illustrated as an integral component of the computer 802, in alternative implementations, memory 808 can be external to the computer 802.

The application 810 is an algorithmic software engine providing functionality according to particular needs, desires, or particular implementations of the computer 802, particularly with respect to functionality described in this disclosure. For example, the application 810 can serve as one or more components, modules, applications, et al. Further, although illustrated as a single application, the application may be implemented as multiple applications on the computer 802. In addition, although illustrated as integral to the computer 802, in alternative implementations, the application 810 can be external to the computer 802.

There may be any number of the computer 802 associated with, or external to, a computer system containing computer 802, each computer 802 communicating over network 816. Further, the term "client," "user," and other appropriate terminology may be used interchangeably as appropriate without departing from the scope of this disclosure. Moreover, this disclosure contemplates that many users may use one of the computer 802, or that one user may use multiple computers.

In some embodiments, the computer 802 is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A method comprising:

providing an electrical submersible pump assembly (ESP) with a pump, an intake, a gel canister, a protector, and a motor disposed in a casing;

providing fluid communication between a production tubing and the ESP, the production tubing delivering well fluid containing solid particles and liquids from the ESP into a wellhead assembly through an inner bore of the production tubing;

locating a pressure release conduit configured in a closed state, between a canister exterior in a hydraulic communication with a canister inner chamber of the gel canister and the inner bore, wherein the closed state prevents the hydraulic communication between the canister inner chamber and the inner bore, placing the pressure release conduit in an open state, wherein the open state allows the hydraulic communication between the canister inner chamber and the inner bore, and delivering a canister contents to the well fluid.

2. The method of claim 1, wherein the pressure release conduit is configured to deliver the canister contents to the inner bore.

3. The method of claim 1, wherein placing the pressure release conduit in the open state delivering the canister contents further comprises:

detecting a signal, and configuring the pressure release conduit to the open state upon detecting the signal.

4. The method of claim 1, wherein placing the pressure release conduit in the open state further comprises:

detecting a pressure, and placing the pressure release conduit in the open state upon detecting the pressure.

5. The method of claim 1, wherein placing the pressure release conduit in the open state further comprises detecting a pressure at a pressure detector and placing the pressure release conduit in the open state upon detecting a predetermined pressure.

6. The method of claim 1, wherein the pressure release conduit further comprises a check valve configured to place the pressure release conduit in the open state to deliver the canister contents upon detecting that a predetermined criterion is met;

wherein the inner bore comprises a bore pressure; and wherein the canister inner chamber comprises a chamber pressure;

wherein the predetermined criterion is a pressure differential between the bore pressure and the chamber pressure.

7. The method of claim 1, wherein the canister contents comprises a stored gel configured to form a slurry with a suspended particle;

wherein the slurry comprises a slurry density below a formation fluid density.

8. The method of claim 1, wherein the canister contents comprises a density range of from about 0.4 g/cc (grams per cubic centimeter) to 0.6 g/cc.

9. The method of claim 1, wherein the canister contents comprises:

an aqueous dispersion mixture;

a density-reducing agent;

a low-density filler;

a gelation control agent; and a pH control agent.

10. The method of claim 9, wherein the aqueous dispersion mixture comprises a colloidal silica dispersion in a range of from 20% to 40% solid by weight;

wherein the density-reducing agent comprises a hollow glass microsphere (HGM); and wherein the low-density filler comprises thermoplastic microspheres;

wherein the gelation control agent comprises a salt in a gelation range of from 1% to 5%.

11. A system comprising:

an electrical submersible pump assembly (ESP) with a pump, an intake, a gel canister, a protector, and a motor disposed in a casing;

a production tubing in fluid communication with the ESP and comprising an inner bore sized to deliver well fluid containing solid particles and liquids from the ESP into a wellhead assembly;

a pressure release conduit configured in a closed state disposed between a canister exterior in a hydraulic communication with a canister inner chamber of the gel canister and the inner bore, wherein the closed state prevents the hydraulic communication between the canister inner chamber and the inner bore; and a canister contents disposed in the canister inner chamber of the gel canister configured to be delivered to the well fluid.

12. The system of claim 11, wherein the pressure release conduit is configured to deliver the canister contents from the gel canister to the inner bore.

13. The system of claim 11, wherein the pressure release conduit further comprises an open state allowing the hydraulic communication, using the canister exterior, between the canister inner chamber and the inner bore;

wherein delivering the canister contents further comprises:

detecting a signal, and configuring the pressure release conduit to the open state upon detecting the signal.

14. The system of claim 11, wherein delivering the canister contents further comprises:

detecting a pressure, and opening the pressure release conduit upon detecting a detected pressure.

15. The system of claim 11, wherein delivering the canister contents further comprises:

detecting a pressure at a pressure detector, and opening the pressure release conduit upon detecting a predetermined pressure.

16. The system of claim 11, wherein the pressure release conduit further comprises a check valve configured to open the pressure release conduit to deliver the canister contents upon detecting that a predetermined criterion is met;

wherein the inner bore comprises a bore pressure; and wherein the canister inner chamber comprises a chamber pressure;

wherein the predetermined criterion is a pressure differential between the bore pressure and the chamber pressure.

17. The system of claim 11, wherein the canister contents comprises a stored gel configured to form a slurry with a suspended particle;

wherein the slurry comprises a slurry density below a formation fluid density.

18. The system of claim 11, wherein the canister contents comprises a density range of from about 0.4 g/cc (grams per cubic centimeter) to 0.6 g/cc.

19. The system of claim 11, wherein the canister contents comprises:

an aqueous dispersion mixture;

a density-reducing agent;

a low-density filler;

a gelation control agent; and a pH control agent.

20. The system of claim 19, wherein the aqueous dispersion mixture comprises a colloidal silica dispersion in a range of from 20% to 40% solid by weight;

wherein the density-reducing agent comprises a hollow glass microsphere (HGM); and wherein the low-density filler comprises thermoplastic microspheres;

wherein the gelation control agent comprises a salt in a gelation range of from 1% to 5%.

21. The system of claim 11, further comprising:

a capillary line configured to transfer a gel, using a gel pump coupled to a gel source, from the gel source to the gel canister; and a gel supply tank at a wellsite configured to provide the gel source of the gel disposed in the gel supply tank;

wherein the gel canister is coupled to the ESP and configured to store the gel.

* * * * *